US010196810B2

(12) United States Patent
Bouveng et al.

(10) Patent No.: US 10,196,810 B2
(45) Date of Patent: Feb. 5, 2019

(54) BUILDING WITH MODULES AND METHOD FOR MOUNTING SUCH A BUILDING

(71) Applicant: MY FIRST HOME AB, Knivsta (SE)

(72) Inventors: Magnus Bouveng, Knivsta (SE); Jan Pettersson, Sollentuna (SE)

(73) Assignee: MY FIRST HOME AB, Knivsta (SE)

( * ) Notice: Subject to any disclaimer, the term of this patent is extended or adjusted under 35 U.S.C. 154(b) by 0 days.

(21) Appl. No.: 15/115,734

(22) PCT Filed: Jan. 30, 2015

(86) PCT No.: PCT/SE2015/050104
§ 371 (c)(1),
(2) Date: Aug. 1, 2016

(87) PCT Pub. No.: WO2015/115990
PCT Pub. Date: Aug. 6, 2015

(65) Prior Publication Data
US 2017/0167128 A1 Jun. 15, 2017

(30) Foreign Application Priority Data
Jan. 31, 2014 (SE) ..... 1450107

(51) Int. Cl.
*E04B 1/20* (2006.01)
*E04B 1/348* (2006.01)
*E04H 1/00* (2006.01)

(52) U.S. Cl.
CPC ..... *E04B 1/34807* (2013.01); *E04B 1/20* (2013.01); *E04H 1/005* (2013.01)

(58) Field of Classification Search
CPC ..... E04B 1/34807; E04B 1/20; E04H 1/005
USPC ..... 52/79.12
See application file for complete search history.

(56) References Cited

U.S. PATENT DOCUMENTS 2,499,498 A * 3/1950 Hammond, Jr. .... E04B 1/34807 414/277
3,495,371 A 2/1970 Mitchell, Jr.
3,514,910 A * 6/1970 Comm ..... E04B 1/34807 52/223.7

(Continued)

FOREIGN PATENT DOCUMENTS

DE 102011109102 A1 2/2013
FR 75926 A1 8/1961

OTHER PUBLICATIONS

European Search Report for corresponding European application No. 15 742 979.6 dated Nov. 13, 2017.

*Primary Examiner* — Paola Agudelo
(74) *Attorney, Agent, or Firm* — Browdy and Neimark, PLLC

(57) ABSTRACT

The present invention relates to a building and a method for assembling a building. The building comprises an external framework 10 with at least three external walls connected with a floor structure and a roof structure such that a space is formed within said framework, the external framework further comprises a support system for each floor, and at least two modules 1, wherein each module comprises four walls 2*a*,2*b*,2*c*,2*d*, a floor 4 and a roof 3, wherein said at least two modules are mounted in the space in said external framework, which said at least two modules rests on said support system 15, such that an air gap of at least 150 mm is formed between two adjacent walls of said at least two modules.

15 Claims, 5 Drawing Sheets

(56) References Cited

U.S. PATENT DOCUMENTS

| | | | | | |
|---|---|---|---|---|---|
| 3,623,296 | A * | 11/1971 | Santoro | E04B 1/34807 | 52/79.12 |
| 3,638,380 | A * | 2/1972 | Perri | E04B 1/24 | 52/653.1 |
| 3,678,638 | A * | 7/1972 | Mougin | E04B 1/34807 | 52/208 |
| 3,823,520 | A * | 7/1974 | Ohta | E04B 1/24 | 52/73 |
| 3,866,672 | A * | 2/1975 | Rich, Jr. | E04B 1/34807 | 165/50 |
| 3,872,641 | A * | 3/1975 | Falkenberg | E04C 2/36 | 411/460 |
| 3,938,289 | A * | 2/1976 | Falkenberg | E04C 2/36 | 411/477 |
| 3,974,608 | A * | 8/1976 | Grearson | E04B 2/60 | 52/235 |
| 4,059,931 | A * | 11/1977 | Mongan | E04B 1/22 | 52/223.5 |
| 4,073,104 | A * | 2/1978 | Bolanz | E04B 1/24 | 52/125.2 |
| 4,592,175 | A | 6/1986 | Werner | | |
| 4,679,370 | A * | 7/1987 | Samuelsson | E04B 2/7403 | 52/475.1 |
| 4,779,552 | A * | 10/1988 | Harsia | B63B 3/08 | 114/65 R |
| 5,233,808 | A | 8/1993 | Salmenmaeki et al. | | |
| 6,470,630 | B1 * | 10/2002 | Miyamoto | E04B 1/34807 | 52/64 |
| 9,663,937 | B2 * | 5/2017 | Goldman | E04B 1/3483 | |
| 2007/0144079 | A1 * | 6/2007 | Hourihan | E04B 1/34807 | 52/79.1 |
| 2009/0019811 | A1 * | 1/2009 | Goldman | E04B 1/34807 | 52/653.2 |
| 2016/0312485 | A1 * | 10/2016 | Wilson | E04H 1/005 | |

* cited by examiner

BUILDING WITH MODULES AND METHOD FOR MOUNTING SUCH A BUILDING

TECHNICAL FIELD

The present invention relates to a building comprising an external framework with at least three outer walls connected with a floor structure and a roof structure such that a space is formed within said framework, and at least two modules, wherein each module comprises four walls, a floor and a roof, wherein said at least two modules are mounted in the space in said external framework such that an air gap of at least 150 mm is formed between two adjacent walls of said at least two modules.

BACKGROUND

In order to simplify the building process when a larger building, such as for example an apartment building or an office complex, is to be constructed it is previously known to use prefabricated modules that are inserted in a larger framework. Such modular construction methods are well known.

However there are many considerations that are needed in order to achieve a building of good quality, both regarding design and manufacturing of the modules, and regarding properties of the framework such that demands on structural strength, insulation properties, living environment and a safe and practical mounting of the modules can be achieved.

Therefore, there is room for improvements within this area, such that a building that fulfills the established building norms and quality demands and simultaneously is cost effective to build and maintain can be obtained.

SUMMARY OF THE INVENTION

The purpose of the present invention is to achieve a building with modular units and a way to build such a building that improves the existing construction within the field. This is achieved by the attached independent claims.

Due to the invention energy-efficient and cost-efficient homes and offices can be constructed, wherein each module only needs a limited insulation in the walls simultaneously as the building in its total fulfills the established building norms. Since, a relatively wide air gap surrounds each module a continuous space surrounding all modules in the building is formed, and the air in this space contributes to insulation and decreases heat leakage from the modules such that a convenient inner temperature can be achieved without unnecessary energy consumption.

For the construction of a building according to the present invention, a framework with at least three walls is provided, and each module is pushed horizontal and parallel with at least one of the walls of the framework to a suitable position.

Thereafter, a fourth wall can be mounted along the side of the framework from which the module was pushed in; alternatively, a wall of the module can form an external wall of the framework. Thanks to this simple and practical assembly the building can be completed easily and practically, and in future when a need of repair or renovation may occur, a current module is removed and transported to a factory for repair or may even be discarded and replaced by a new module without requiring major interference with the building.

Another advantage with the invention is that due to the stable framework high buildings with several floors can be constructed without decreasing structural strength and safety of the building.

More advantages of the invention will be described below with reference made to the accompanying detailed description and claims.

DETAILED DESCRIPTION

Figure 1A:
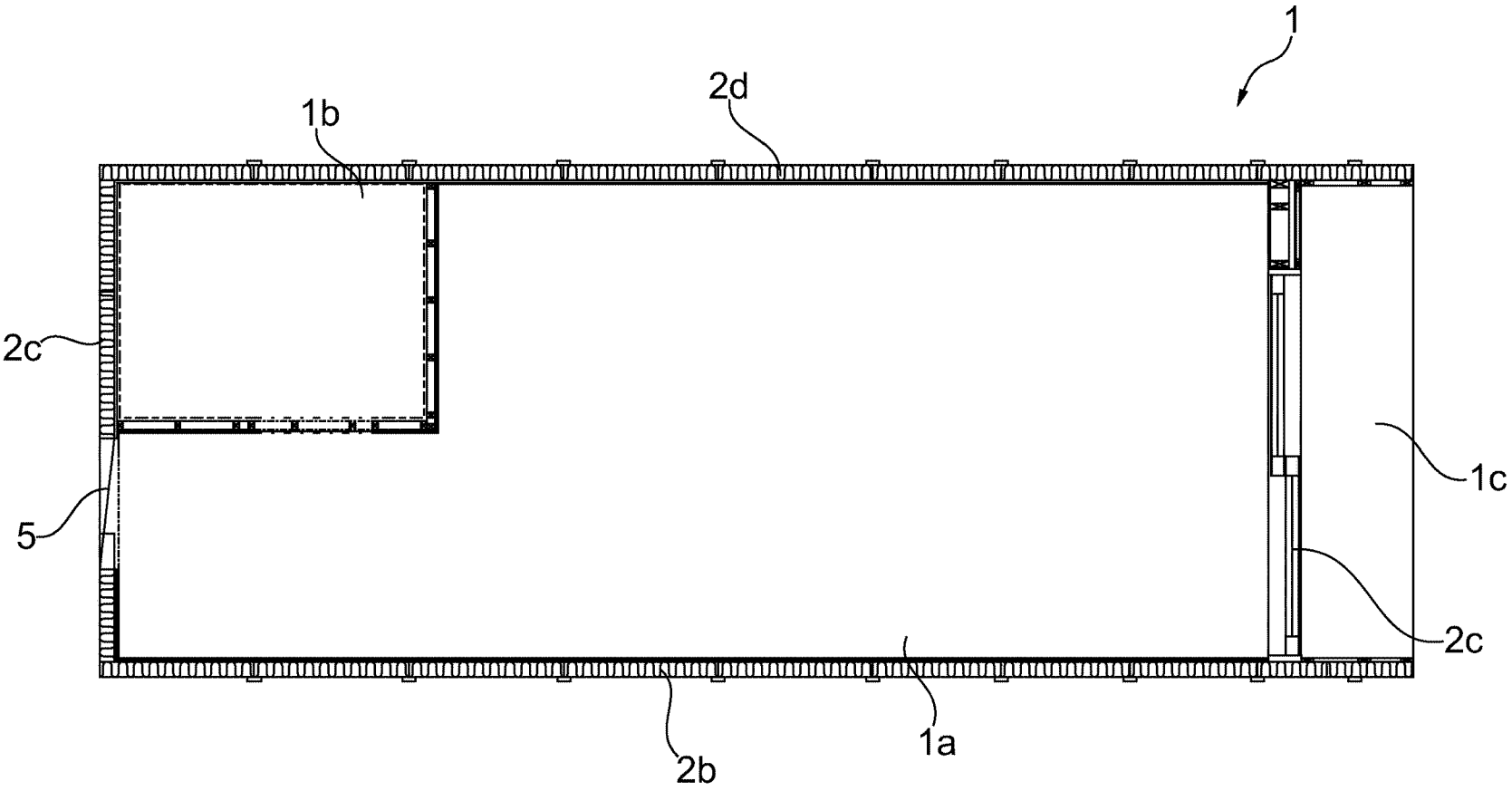
FIG. 1*a* shows a planner view of a module from above.

FIG. 1*a* shows a preferred embodiment of a module 1, according to the invention seen from above. the module 1 has four walls 2*a*, 2*b*, 2*c*, 2*d* that encloses a space 1*a* that is suitable as a home or as an office. In this embodiment is a smaller space 1*b* divided and can be used as a bathroom, and at the first short wall 2*a* the long sidewalls 2*b*, 2*d* are extended such that a balcony 1*c* can be created. This first short wall 2*a* comprises preferably a door for connecting the balcony 1*c* with the space 1*a*, and a second short wall 2*c* comprising a door 5 provided for accessing the space 1*a* from an outside of the module 1. The module 1 is designed to be mounted in a framework 10 (see FIG. 2*a*-2*c*) such that the framework surrounds the module on all sides except at the first short wall 2*a* were the balcony 1*c* is provided. By that, the other walls, namely the other short wall 2*c* and both long side walls 2*b*, 2*d* can be constructed as thin layers and with very limited insulation ability, due to the insulating external walls of the framework 10 together with an air gap formed between the module 1 and the framework 10 sufficient insulation properties of the module 1 to provide a pleasant in-house climate in an energy effective manner. The minimum width of the air gap is given by the dimension of the vertical element 18 of the framework 15, which exhibits a smallest cross-sectional dimension of 150 mm in order to provide sufficient structural strength for the framework 10. Thus, the structural strength dimensioned vertical element 18 can be used to provide a desired insulation property by the formed air gap. In this preferred embodiment are the walls of the long sides 2*b*, 2*d* and the other short side 2*c* are constructed with 120 mm sandwich panel that comprises insulation covered by two layers of sheet metal and on the inside that faces the space 1*a* is also covered by 15 mm plywood and 13 mm plaster, which in total gives a wall thickness of 148 mm. Due to this construction of the walls the module 1 can be manufactured in a cost efficient manner, of course other types of walls are possible for module 1 but due to the framework 10 and the air gap explained below, a rather thin wall with limited insulation properties is enough.

The first short wall 2*a* is preferably more insulated than the other walls.

Figure 1B:
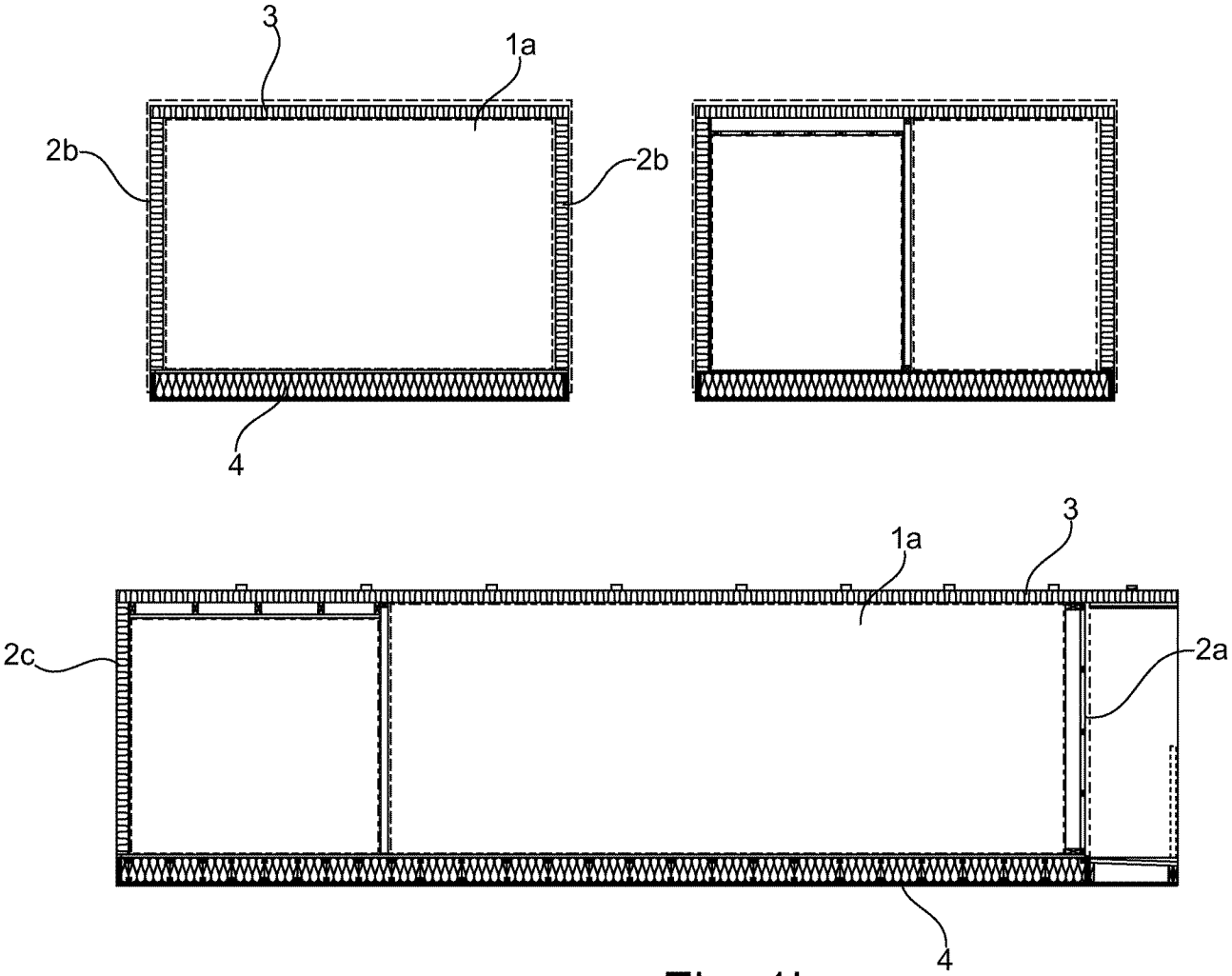
FIG. 1*b* shows a cross-section view of a module from a short side.

In FIG. 1*b* the module 1 is shown in a cross-section from a long side, such that both short walls 2A, 2*c* are visible together with a roof 3 and a floor 4 of the module. The roof 3 can essentially have the same construction as the walls 2B, 2C, 2*d* with a sandwich panel comprising two layers of sheet metal with intermediate insulation and a plasterboard on the side of the roof 3 facing the inside of the module 1, such that the total thickness of the roof is about 133 mm. The floor 4 may comprise a fibre cement board such as Cembrit Multi Force, covered by a layer of playwood and a layer of chipboard that encloses a layer of loose wool as insulation. The top of the floor 4 may comprise an outer layer such as parquet, to a total thickness of the floor 4 of about 300 mm. However, it shall be noted that the compositions of the roof 3 and the floor 4 as well as the walls above are merely examples and does not exclude other suitable compositions. However, it is preferred that the floor 4 comprises a structural floor and an insulation layer such that sound leakage through the floor 4 can be avoided and sound attenuation may be provided. Between the space 1*a* and the smaller space 1*b* can a thinner wall be constructed, and if the smaller space 1*b* is provided to serve as a bathroom suitable surface layers are incorporated for this, together with connections for electricity and water. In the space 1*a* can a kitchen also be arranged, and likewise connections for electricity and water may be provided.

Figure 2B:
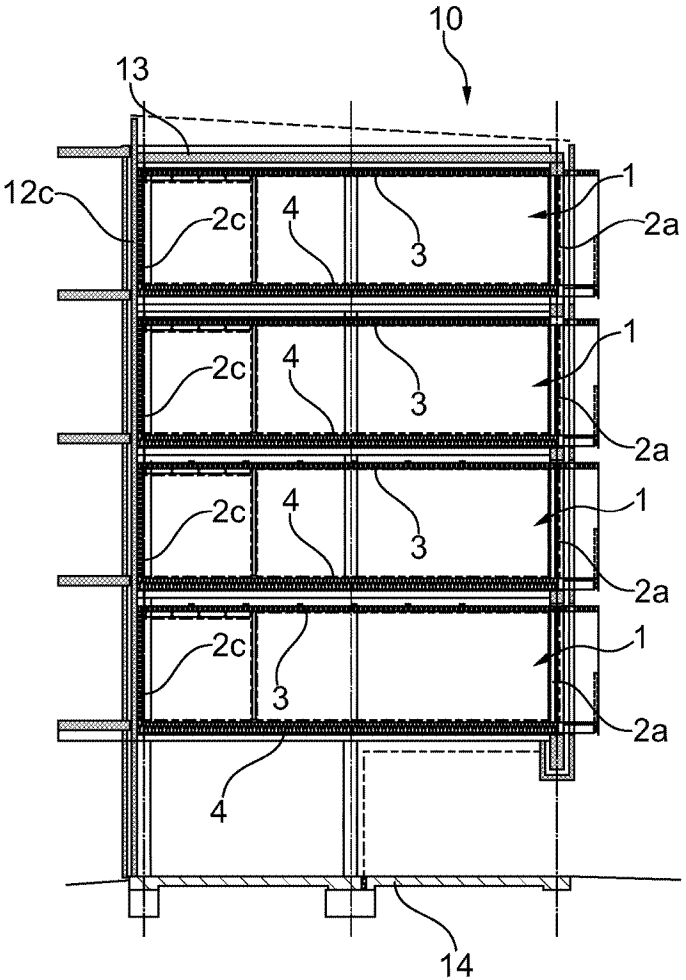
FIG. 2*b* shows the same view as in FIG. 2*a* but with modules placed in the framework.
Figure 2A:
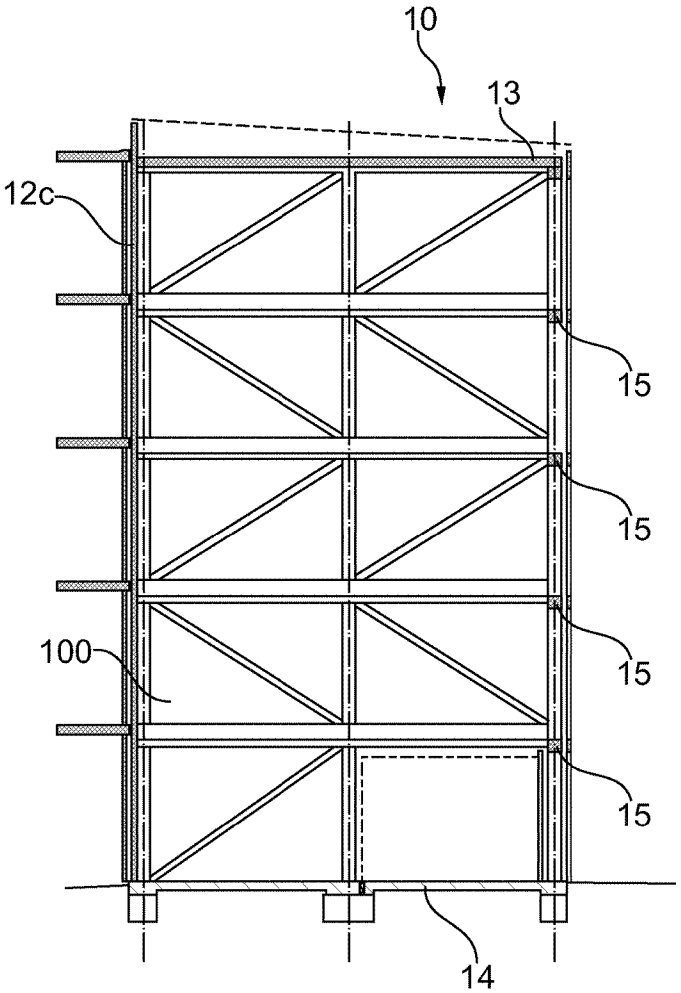
FIG. 2*a* shows a cross-section view of a framework from a short side.

FIG. 2*a* shows a framework 10 for a building seen from a short side, where a number of modules 1 can be mounted and form apartments, office units or other types of rooms. The framework 10 has a roof 13 and the floor 14 and in this embodiment at least one long wall 12*c*. In this preferred embodiment of the framework 10 there is also four floors and a a basement floor, and on each floor of the framework 10 there is also a support system 15 on which modules 1 can rest, as will be described in more detail below. In FIG. 2*b* the same framework 10 with a module 1 mounted on each floor and supported by the support system 15 is shown.

During assembly the framework 10 is provided with the long wall 12*c* mounted, and thereafter each module is pushed in position in essentially horizontal direction from the right side in FIG. 2*a*-2*b* i.e. from the side where a short wall is missing. The module 1 is inserted to a suitable position where the other short wall 2*c* of the module 1 abuts the long wall 12*c* of the framework 10 and the module 1 rests on the support system 15. The first short wall 2*a* then forms an external wall also for the framework 10 and the sealing is mounted to prevent heat leakage from the inner of the framework 10, the sealing may in one preferred embodiment comprise fiberglass.

Figure 2C:
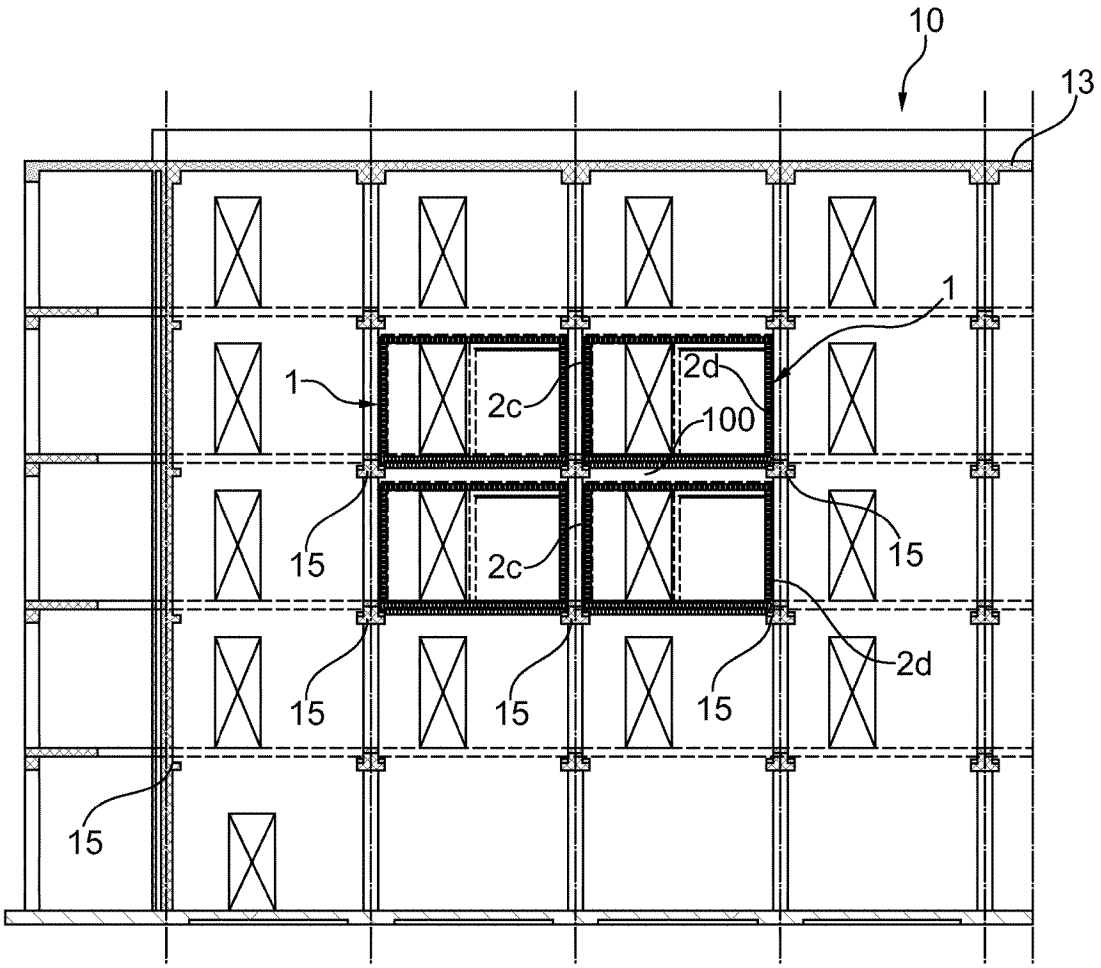
FIG. 2*c* shows a cross-section view of the framework from a short side.
Figure 2D:
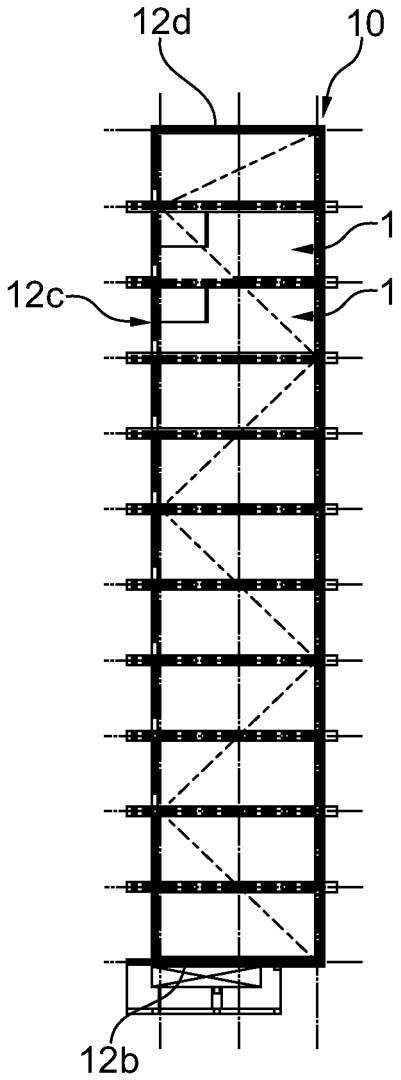
FIG. 2*d* shows a cross-section view of the framework from above.

In FIG. 2*c* the framework 10 is shown from a long side, where four modules 1 are visible in the framework 10, whereas space remains for a number of additional modules 1 around them. Each module 1 rests on the support system 15 being in form of concrete beams designed as inverted T's so ledges are formed on both sides of the module 1 on which corner of module 1 may rest. Between these concrete beams preferably a number of supports 16 runs across and parallel with the floor 4 of the module 1, such that structural strength and safe support are achieved. These supports 16 are shown in FIG. 2D. Between the long walls 2*b*, 2*d* of a module 1 and the walls of the next module 1 and between the roof 3 of each module 1 and the floor 4 of the above module 1 is an air gap 100 that extends through the inner of the framework 10 and thereby surrounds all modules 1. This air gap has a minimum width of at least 150 mm, between the walls of two modules 1 as well as between a module 1 and an external wall of the framework 10. Due to this rather wide air gap an improved insulation for each module may be achieved, such that the walls 2*a*, 2*b*, 2*c*, and 2*d* of the module 1 can be constructed in the above disclosed manner, thus with a very limited thickness and insulating properties. Through cooperation between the external walls of the framework 10 and the surrounding air gap 100 can a pleasant indoor climate nevertheless be created in each module 1 at a low manufacturing cost for the module 1 due to the decreased demands on insulation of the walls of the module.

In FIG. 2*c* the framework 10 is shown from above, with two modules 1 mounted. The air gap 100 is also shown here with its smallest width between both the modules 1.

During construction of the building the framework 10 is first provided, in this preferred embodiment with walls along both short sides and one long side, and with a roof 13 and a floor 14. The framework 10 may have space for modules 1 in several floors, or may have a single floor wherein at least one but preferably a plurality of modules 1 can be placed side by side. The external walls of the framework 19 are constructed to provide sufficiently good insulation. Each module 1 can then be lifted to a suitable height and be pushed into the frame in horizontal direction from the long side without an external wall. The module 1 is pushed parallel with the short sides of the framework 10 and placed on the support system 15 such that it rests stable within the framework 10. If the framework 10 has only one floor the module 1 may alternatively be placed directly on the floor 14 of the framework 10, even if an air gap between this floor 14 and the floor 4 of the module may be preferred from an insulation point of view. When the module 1 has been placed in the framework 10, additional modules 1 may be pushed in such that the framework 10 is filled, and thereafter can an additional external wall of the framework 10 in some embodiments be mounted along the long side such that the modules are enclosed in the framework 10. Alternatively, the short wall 2*a* may form an external wall of the framework 10 as in the preferred embodiment and thereby the whole building. A sealing can be added such that the distance between the short walls 2*a* of two modules 1 is sealed and heat leakage from the building is prevented. If the module 1 comprises a bathroom or a kitchen connections may be prepared in the framework, for example along the long side of the framework 10 that has been in place during the whole assembly, and electricity can also be connected to each module there.

During use of the building it might happen that some module needs considerable repair, for example due to a damage or due to wear caused by the age of the module 1. By directly grip the specific module 1 and pull it out of the framework 10 the same way as during insertion the module 1 may be removed and reparation and renovation might be performed in another location, such as a factory or workshop in a simple and practical manner. If the module 1 is severely damaged or too old such that a repair is considered to be unprofitable the module may easily be replaced by a new module 1 that can be pushed into the place of the old module 1.

In the event of fire in the building, burning modules may directly be lifted out of the building for extinction, in order to prevent the fire from spreading to more modules 1 in the building. Due to the properties and stability of the framework 10 there is no risk for the whole building to collapse during vigorous fire, which means that damages of properties and persons may be reduced. In the event that the fire is so serious that all modules 1 are ravaged by fire, they can easily be replaced with new ones which speeds up the repair and clearing after the fire. The same obviously applies to other types of damage, such as water damages and the like.

The invention claimed is:

1. A building comprising:

an external framework with at least three external walls connected with a floor structure and a roof structure such that a space is formed within said external framework, the external framework further comprising:

a support system for each floor, and at least two modules, wherein each module comprises two short side walls, two long side walls, a floor and a roof, wherein said at least two modules are mounted in the space in said external framework, said at least two modules resting on said support system, wherein said at least two modules are configured to be inserted into said framework from the same side of the building in an insertion direction, said insertion direction extending parallel with the two long side walls of said at least two modules, such that an air gap having a width of at least 150 mm is defined between two adjacent long side walls of said at least two modules inserted into said external framework from the same side of the building in the insertion direction and between a long side wall of at least one of said at least two modules inserted into said external framework from the same side of the building in the insertion direction and one of said external walls of said external framework, wherein the width of the air gap extends perpendicular to the insertion direction of the at least two modules, wherein the four walls of each module are constituted by two short side walls and two long side walls, and wherein one of the short side walls is more insulated than the other short side wall and the two long side walls.

2. The building according to claim 1, wherein one wall of the module in mounted position also forms a part of an outer wall of the framework.

3. The building according to claim 1, wherein said support system comprises T-bars on which the floor of the module rests.

4. The building according to claim 1, wherein the four walls of each module comprise a sandwich panel comprising two layers of sheet metal with intermediate insulation disposed between the layers, and a plasterboard on a side of each wall facing an inside of the module.

5. The building according to claim 1, wherein the roof of each module comprise a sandwich panel comprising two layers of sheet metal with intermediate insulation disposed between the layers, and a plasterboard on a side of each wall facing an inside of the module.

6. The building according to claim 1, wherein the floor comprises a fiber cement board covered by a layer of plywood and a layer of chipboard that encloses a layer of insulation between the layer of plywood and the layer of chipboard.

7. A method for assembling a building, comprising the steps of:

providing an external framework with at least three external walls connected with a floor structure and a roof structure such that a space is formed within said external framework, the external framework further comprises a support system for each floor, providing at least two modules, wherein each of said at least two modules comprises two short side walls, two long side walls, a roof and a floor, mounting said at least two modules in said external framework by pushing the at least two modules in a horizontal direction parallel with one external wall of the framework, each of said at least two modules being inserted into the external framework in an insertion direction from the same side of the building, wherein the insertion direction extends parallel with the two long side walls of said at least two modules, and placing said at least two modules inside said external framework resting on said support system with an air gap of at least 150 mm defined between two long side walls of adjacent ones of said at least two modules being inserted into the external framework from the same side of the building in the insertion direction, the width of the air gap extending perpendicular to the insertion direction of the at least two modules.

8. The building according to claim 1, wherein the air gap surrounds each module providing a continuous space surrounding all modules that provides insulation for each module.

9. A building comprising:

an external framework with at least three external walls connected with a floor structure and a roof structure such that a space is formed within said external framework, the external framework further comprising:

a support system for each floor, and at least two modules, wherein each module comprises two short side walls, two long side walls, a floor and a roof, wherein said at least two modules are mounted in the space in said external framework, said at least two modules resting on said support system, wherein said at least two modules are configured to be inserted into said framework from the same side of the building in an insertion direction, said insertion direction extending parallel with the two long side walls of said at least two modules, such that an air gap having a width of at least 150 mm is defined between two adjacent long side walls of said at least two modules inserted into said external framework from the same side of the building in the insertion direction and between a long side wall of at least one of said at least two modules inserted into said external framework from the same side of the building in the insertion direction and one of said external walls of said external framework, wherein the width of the air gap extends perpendicular to the insertion direction of the at least two modules, wherein the four walls of each module are constituted by two short side walls and two long side walls, and wherein the building further comprises a sealing arranged to seal the distance between two of the short walls of the two modules.

10. The building according to claim 9, wherein one wall of the module in mounted position also forms a part of an outer wall of the framework.

11. The building according to claim 9, wherein said support system comprises T-bars on which the floor of the module rests.

12. The building according to claim 9, wherein the air gap surrounds each module providing a continuous space surrounding all modules that provides insulation for each module.

13. The building according to claim 9, wherein the four walls of each module comprise a sandwich panel comprising two layers of sheet metal with intermediate insulation disposed between the layers, and a plasterboard on a side of each wall facing an inside of the module.

14. The building according to claim 9, wherein the roof of each module comprise a sandwich panel comprising two layers of sheet metal with intermediate insulation disposed between the layers, and a plasterboard on a side of each wall facing an inside of the module.

15. The building according to claim 9, wherein the floor comprises a fiber cement board covered by a layer of plywood and a layer of chipboard that encloses a layer of insulation between the layer of plywood and the layer of chipboard.

* * * * *